US006925373B2

(12) United States Patent
La Rosa et al.

(10) Patent No.: US 6,925,373 B2
(45) Date of Patent: Aug. 2, 2005

(54) VIRTUAL SENSOR FOR THE EXHAUST EMISSIONS OF AN ENDOTHERMIC MOTOR AND CORRESPONDING INJECTION CONTROL SYSTEM

(75) Inventors: Manuela La Rosa, Giarre (IT); Donata Nicolosi, Sangregorio (IT); Giuseppe Esposito Corcione, Marigliano (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 82 days.

(21) Appl. No.: 10/696,500

(22) Filed: Oct. 29, 2003

(65) Prior Publication Data

US 2004/0112125 A1 Jun. 17, 2004

(30) Foreign Application Priority Data

Oct. 29, 2002 (EP) ..... 02425651

(51) Int. Cl.[7] ..... B60T 7/12

(52) U.S. Cl. ..... 701/109; 123/672; 123/676; 60/274; 60/276; 73/116; 73/117.3; 73/118.1

(58) Field of Search ..... 701/109; 123/672, 123/676; 60/274, 276; 73/116, 117.3, 118.1

(56) References Cited

U.S. PATENT DOCUMENTS 5,682,317 A 10/1997 Keeler et al. ..... 364/431
5,956,948 A 9/1999 Nagashima et al. ..... 60/297
6,236,908 B1 * 5/2001 Cheng et al. ..... 701/1
6,425,372 B1 7/2002 Hiltner ..... 123/435

FOREIGN PATENT DOCUMENTS

DE 100 10 681 9/2001 ..... B60R/16/02
DE 100 43 383 3/2002 ..... F02D/45/00
EP 0 877 309 11/1998 ..... G05B/23/02

OTHER PUBLICATIONS

Ludwig et al.; "Measurement and Monitoring of Pressure Curves in Diesel Engines", Published Jun. 2, 1993; Proceedings o the 1993 American Control Conference held on Jun. 2–4, 1993; TP4–17:20 vol. 2 of 3; pp. 1796–1800.

* cited by examiner

*Primary Examiner*—Tony M. Argenbright
*Assistant Examiner*—Johnny H. Hoang
(74) *Attorney, Agent, or Firm*—Lisa K. Jorgenson; Allen, Dyer, Doppelt, Milbrath & Gilchrist, P.A.

(57) ABSTRACT

The invention relates to a virtual sensor of exhaust emissions from a fuel-injection endothermic engine having a combustion chamber in each of its cylinders, a fuel injector serving each combustion chamber, and an electronic fuel-injection control unit. Advantageously, the virtual sensor includes an input interface receiving a signal from at least one pressure sensor for measuring the pressure inside at least one combustion chamber of the engine, a second input interface receiving signals from the electronic fuel-injection control unit, and a calculation block to provide estimates of the amounts of nitrogen compounds and particulates in the emissions based on the pressure and other relevant signals to the engine operation.

23 Claims, 5 Drawing Sheets

VIRTUAL SENSOR FOR THE EXHAUST EMISSIONS OF AN ENDOTHERMIC MOTOR AND CORRESPONDING INJECTION CONTROL SYSTEM

FIELD OF THE INVENTION

The present invention relates to a virtual sensor of exhaust emissions from a fuel-injection endothermic engine, and to an associated fuel injection control system for a direct type of fuel injection system. More specifically, the invention relates to a virtual sensor of exhaust emissions from a fuel-injection endothermic engine having a combustion chamber in each of its cylinders, a fuel injector serving each chamber, and an electronic fuel-injector control unit. This invention is related to the subject-matter of European Patent Application 01830645.6 by the Applicant, incorporated by reference herein.

BACKGROUND OF THE INVENTION

As it is well known, there is global concern for the release of contaminants to the atmosphere, a trend that has materialized in the imposition of stricter standards on motor vehicle exhaust gas emissions. Particularly the European Union has adopted restrictive regulations for application within 2005 to both the exhaust emissions and the fuel consumption of motor vehicles. The most significant of these regulations—some of which are already in force while others are due to come in force soon—are summarized here below:

Euro I (91/441): for reduced emissions of pollutants, this directive has made the installation of a catalyzed exhaust system compulsory for all vehicles, registered since Jan. 1, 1993.

Euro II (96/69): applies to models registered since 1996 and sold up to December 2000.

Euro III (98/69): vehicles registered since Jan. 1, 2001 comply with this directive. Besides the problem of polluting emissions, since less pressing, an OBD (On-Board Diagnostics) system is made compulsory to detect malfunctions. Completion of any repairs within a given distance travelled, in number of kilometers, is strictly enforced. This directive, that applies to gasoline powered vehicles, is to become in force for diesel engines in 2003.

Euro IV (98/68B): scheduled for Jan. 1, 2005.

Euro V (2001/27/ EC): scheduled for Jan. 1, 2008.

An estimate of overall emissions is given in Table 1 below; combined technical data (emission factors) and active data (total number of kilometers travelled by the vehicle) have been supplied by the user of a passenger car, and enter the computation:

| Tier | Year | CO | HC | HC + Nox | NOx | PM |
|---|---|---|---|---|---|---|
| Diesel | | | | | | |
| Euro 1 | 1992 | 2.72 | — | 0.97 | — | 0.14 |
| Euro 2-ID1 | 1996 | 1.0 | — | 0.7 | — | 0.08 |
| Euro 2-DI | 1999 | 1.0 | — | 0.9 | — | 0.10 |
| Euro 3 | 2000.01 | 0.64 | — | 0.56 | 0.50 | 0.05 |
| Euro 4 | 2005.01 | 0.50 | — | 0.30 | 0.25 | 0.025 |
| Petrol (Gasoline) | | | | | | |
| Euro 3 | 2000.01 | 2.30 | 0.20 | — | 0.15 | — |
| Euro 4 | 2005.01 | 1.0 | 0.10 | — | 0.08 | — |

Total emission is the sum of the emissions from three different sources, where a first source is the engine in its steady thermal range (warm), a second source is the engine in its warm-up range (cold), and a third source is evaporated fuel. Distinguishing the first two sources is of fundamental importance because considerable emission variations can be observed between the two. During warm-up, the emission of pollutants often exceeds that of the same engine once warmed up, and the pollutant assessing criteria differ. Total emission is calculated by the following formula:

$$E_{TOTAL}=E_{HOT}+E_{COLD}+E_{EVAP}$$

where, $E_{TOTAL}$ is total emitted pollutants of any kind for space and time resolution of the application; $E_{HOT}$ is emission in the steady range of engine operation (warmed up); and $E_{COLD}$ is emission in the warm-up transitory range of engine operation (cold start). $E_{EVAP}$ is emission of the fuel evaporation.

Vehicle emissions are heavily dependent on the engine RPM; e.g. when driving in the city, over country roads, or highways. The pollutants released by an internal combustion (IC) engine are the outcome of incomplete combustion of the air/fuel mixture; or result from compounds, such as lube oil and lube oil additives, reacting together in the combustion chamber; or originate from inorganic components, such as sulphur present in diesel fuel. A major problem with gasoline engines is the emission of nitrogen and carbon compounds, such as $NO_x$ and $CO_2$. With diesel engines, additional to $NO_x$ compounds, carbon is released as DPM (Diesel Particulate Matter). DPM is negligible in gasoline-burning engines.

DPM is a complex mixture of liquid and solid matter, and has for its main constituent solid carbon that is generated from incomplete combustion within the cylinder. DPM usually comes in three fractions: dry carbon/sooty particles, SOFs (Soluble Organic Fractions), and acidic sulphur particles. FIG. 1 schematically shows a clump of particulates, with the nuclei of the materials contained therein clearly in view.

DPM composition is tied to the engine type and the engine operating conditions, foremost among which are speed and loading. Table 2 below shows DPM size and corresponding classification:

| RATING | DIAMETER D ($mX10^{-6}$) |
|---|---|
| PM 10 | <10 |
| Fine | <2.5 |
| Ultra-fine | <1.0 |
| Nano-size particles | <0.05 |

Mainly responsible for the formation of $NO_x$ compounds in both diesel and gasoline engines is the combustion chamber reaching a sufficiently high temperature to cause the nitrogen that is present in the combustion air to break down and re-combine with oxygen to yield nitrogen monoxide (NO) and dioxide ($NO_2$). On the other hand, any attempt at keeping the temperature low inside the combustion chamber to attenuate the formation of $NO_x$ is bound to result in increased DPM release. A major problem with diesel engines is the trade-off between released $NO_x$ and DPM. Reducing this effect is the main objective of diesel emission control, restrictions on DPM emission being even more stringent.

The state of the art offers some approaches to the problem of reducing the polluting emissions from endothermic engines. Such prior proposals apply in different ways to diesel and gasoline engines and include improvements of mechanical as well as electronic quality. A first example of one of these approaches reduces exhaust gas pollution by adopting an electronically controlled exhaust gas re-circulating system (EGR). An electronic control system generates a signal to open a valve placed in an exhaust gas re-circulation duct so as to direct the exhaust gases back into the engine cylinders, thereby lowering the content of $NO_x$ compounds.

In the instance of gasoline engines, also known is to use a lambda probe that cooperates with tervalent catalysts. The latter are capable of converting polluting gases to less harmful gases by an oxidation-reduction process. A catalytic converter usually comprises a metal enclosure containing an essentially honeycombed ceramic or metal substrate coated with a film of γ-alumina, also known as the "wash coat", 40 to 50 $\mu$m thick. This support is deposited on, using appropriate techniques, an active catalytic material consisting of a mixture of noble metals such as platinum, palladium, or rhodium. These metals are deposited in small amounts but spread over the support at a high rate of specific coverage. FIG. 2 schematically shows the resultant ply structure to an enlarged scale.

A lambda probe is fitted in the re-circulation duct between the catalyzer and the engine to instantly read the proportion of residual oxygen in the gas flow that is sweeping past its electrodes. An electric signal is thus generated and supplied to an engine control unit that will process it to adjust the air/gasoline ratio for optimum catalytic conversion. FIG. 3 schematically shows this control arrangement for gasoline engines. More recently, a variable geometry turbo (VGT) has been added to the electronic EGR control, wherein the rotor blade angle is varied and so is the flow of exhaust gas through it according to engine RPM.

For diesel engines to meet Standard EURO III (2000), a high-pressure fuel injection system has been developed, known as the CR (Common Rail) system, wherein a pressure of approximately 1350-bar is attained to effectively lower both pollutant emissions and fuel consumption. This CR system generates injection pressures of a sufficiently high order to atomize the fuel in the combustion chamber such to obtain an almost perfect fuel/air mixing, resulting in reduced unburned exhaust gases and particulates.

A CR system basically comprises a high-pressure radial-piston fuel pump, an accumulator (rail), a series of injectors connected in a high pressure conduit, a control unit, actuators, and a plurality of sensors. The pump maintains the fuel at a high pressure to force it into the accumulator or "rail", the latter serving all the injectors by functioning as a high-pressure reservoir. Some of the fuel is then injected into a respective combustion chamber through electromagnetically operated injectors, and some is returned to the tank for re-circulation.

The circulating flow is determined and balanced by an electronic unit comparing the pressure detected by the sensors with predetermined reference values, and adjusting for any overpressure by diverting the excess fuel back to the tank. The indications from the sensors enable the unit to meter the amount of fuel that is injected so as to suit the engine load and RPM, thereby affording a highly flexible form of fuel control. The pressure level is adequate to meet the engine requirements at all RPM, unlike traditional systems where the pump was driven off the engine, and the pressure depended on the engine RPM and was almost never an optimum level, especially at low RPM.

Current CR-equipped engines have only two injections per cycle (a pilot injection and a main injection). However, recent developments have made the injection system more flexible, in the sense that a better blended mixture has been achieved by splitting the main injection into multiple injections and changing the geometry of the intake conduits for swirl effect.

It will only be possible to conform with impending EURO IV (2005) directives when both the mechanical and electronic aspects of current control systems are further improved. In this respect, conversion for multiple injection and rail pressures of up to 1600 bar is regarded an essential measure.

In turn, injectors should be redesigned for improved mechanics and smaller injection ports. Also contemplated is the installation in the combustion chamber of a precision type of pressure sensor for high temperatures, which would feed back pressure signals for implementing engine control algorithms of far greater accuracy. It is held by many that catalytic post-treatment of exhaust gases will be unavoidable on both gasoline or diesel engines. Each engine has requirements of its own as to reduced emissions, which means that its catalyzer must be suitably tailored, varying several parameters: chemical functions, type of impregnant, amount and type of noble metal, substrate porosity, location in the exhaust line, etc. In either engine types, measuring the exhaust emissions would entail the provision of exhaust sensors that, additional to being themselves fairly expensive items, involve further service and maintenance costs.

To keep the added cost represented by such sensors low, one might think of providing a virtual sensor based on an accurate model of the internal combustion engine operation, be it a diesel or a gasoline type. However, sensors of this kind require modelling to a high degree of accuracy if all the quantities involved in an engine operation and their varying through each engine cycle are to be taken into account. Briefly, using a virtual sensor is bound to reflect on very high processing costs due to the highly complex nature of the model.

The underlying technical problem of this invention is to provide a virtual sensor of the exhaust emissions from a fuel-injection endothermic engine with structural and functional features appropriate to overcome the limitations of the prior art. In particular, this sensor should be simple, effective, and convenient for retrofitting to an existing electronic injection control unit already in use in the motor-vehicle.

SUMMARY OF THE INVENTION

An object of this invention is to provide a virtual sensor of the exhaust emissions from a fuel-injection endothermic engine with structural and functional features appropriate to overcome the limitations of the prior art. In particular, this sensor should be simple, effective, and convenient for retrofitting to an existing electronic injection control unit already in use in the motor-vehicle.

The resolvent idea at the basis of this invention is the one of equipping at least one combustion chamber of an engine with a pressure sensor, and using the signal from the sensor to obtain an estimate or evaluation of the engine exhaust pollutants from a calculation block where a model of the engine operation is run. Particularly, the calculation block is also to receive information about other parameters of the engine operation, such as the crank angle and the injection start time.

BRIEF DESCRIPTION OF THE DRAWINGS

The features and advantages of the virtual sensor and fuel injection control system according to the invention can be appreciated from the following description of embodiments thereof, given by way of example and not of limitation with reference to the accompanying drawings.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 5:
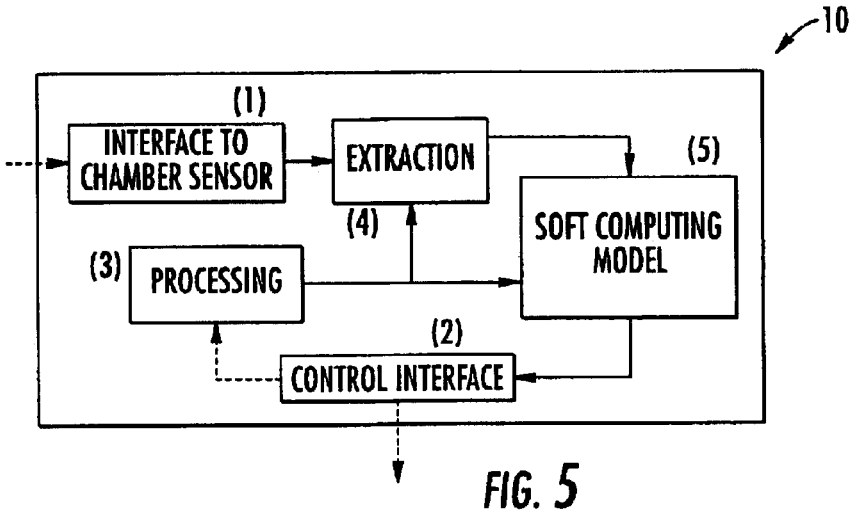
FIG. 5 is a block diagram of a virtual exhaust emission sensor according to the invention.

With reference to the drawings, in particular to the example of FIG. 5, a virtual sensor 10 of the exhaust emissions from a diesel or gasoline engine 9 is described here below.

This sensor 10 includes an interface 1 to a pressure sensor in at least one combustion chamber of the engine 9, an interface 2 to an electronic fuel injection control unit 8 of the engine 9, an extraction block 4 for extracting parameters from the pressure signal issuing from the pressure sensor, a processing block 3 for processing signals from the engine 9, and a calculation block 5 operating according to a soft computing model.

It is to be expected that within a few years all internal combustion engines will be equipped with a combustion chamber pressure sensor. This invention is based on the assumption that such a pressure sensor is available. In particular, tests have been carried out by the Applicant using a bench-mounted Fiat engine 1910 JTD equipped with a high-pressure common rail injection system. Pressure measurements inside the combustion chamber were made by using an AVL precision sensor.

The engine control strategy can be improved by using the pressure sensor, in the respect of controlling the output torque, exhaust emissions, and fuel consumption. Briefly, by having a pressure sensor installed inside the combustion chamber, a simplified model can be constructed, based on the relation borne by the combustion chamber pressure signal to the exhaust emissions, thereby to monitor all the amounts of pollutants being released.

The sensor 10 is input with real-time information from the pressure sensor in the combustion chamber, as well as from conventional sensors arranged to monitor other engine operation parameters. Sensor 10 outputs electric signals corresponding to the amount of pollutant released per engine cycle. The operation of each block in the sensor 10 will now be described.

Figure 1:
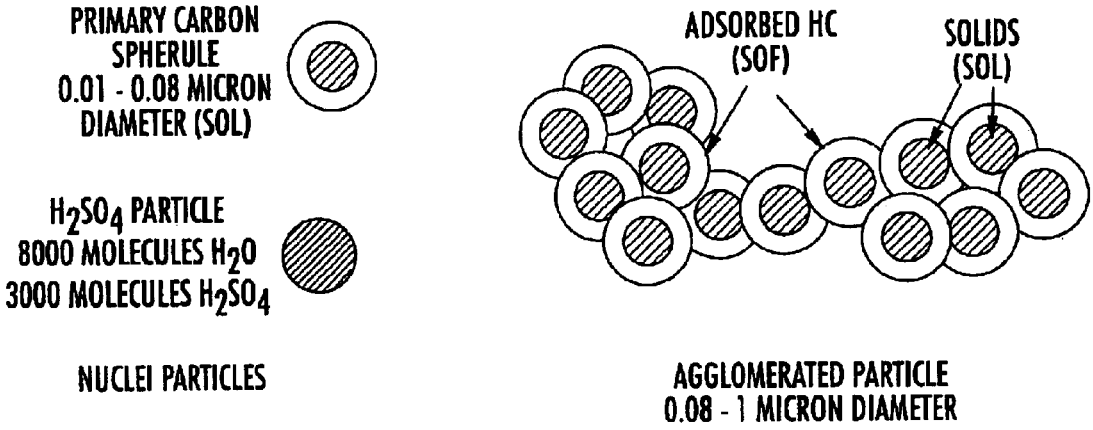
FIG. 1 is a schematic diagram showing an agglomerate of particulates from the exhaust line of an internal combustion endothermic engine.
Figure 2:
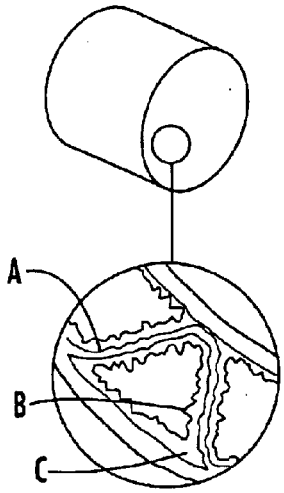
FIG. 2 is an enlarged schematic view of the ply structure of a catalytic converter intended for installation in the exhaust muffler of a motor vehicle.
Figure 3:
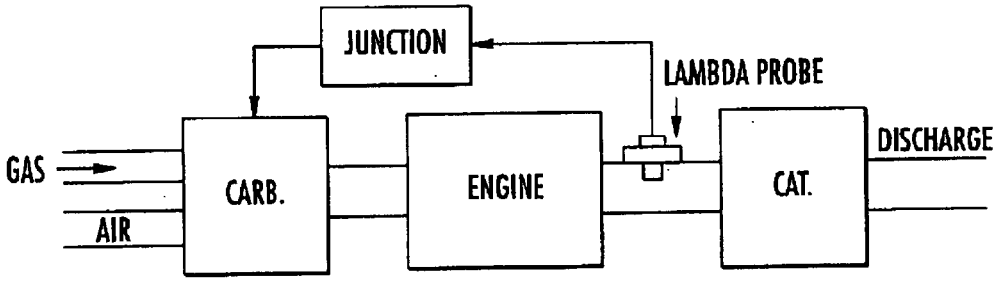
FIG. 3 is a block diagram of an electronic fuel injection control system for a gasoline engine equipped with catalytic exhaust control.
Figure 4C:
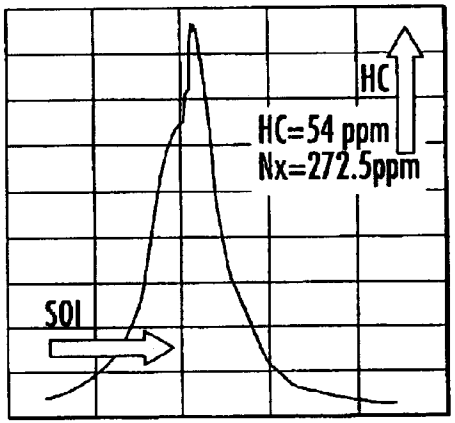
FIGS. 4A, 4B and 4C schematically show respective characteristic curves.
Figure 4B:
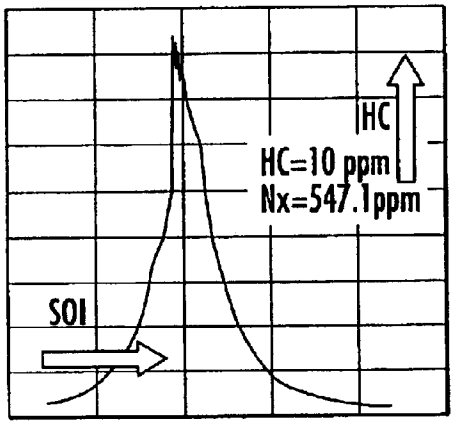
Figure 4A:
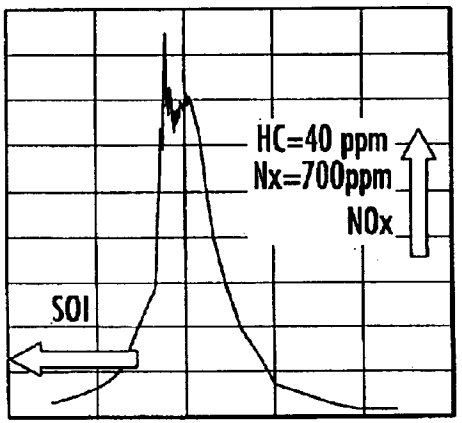

Interface block 1, interfacing to the pressure sensor in the combustion chamber, receives information from the device and converts it to electric signals corresponding to a pressure curve that can be used by block 4. Examples of pressure curves are shown in FIGS. 4A, 4B and 4C. The control unit 8 is interfaced by using a communication protocol that allows necessary information to be exchanged. The fuel injection control unit supplies values of the main engine variables, such as crank angle and injection start time.

Processing block 3 is input with signals from the control unit interface 2, and adjusts the input values for subsequent computation in blocks 4 and 5. The extraction block 4 that is input with the combustion chamber pressure signals provides the calculation block 5 with essential characteristics to be extracted from the pressure curve. The pressure characteristics can be derived from the curve, e.g. peak value, average value, etc. These characteristics are related to the combustion pattern, including start, duration, heat released, combustion chamber temperature, etc. The calculation performed in block 5 is also based on the information supplied by processing block 3 concerning crank angle and fuel injection start time as measured by different engine sensors.

Figure 6:
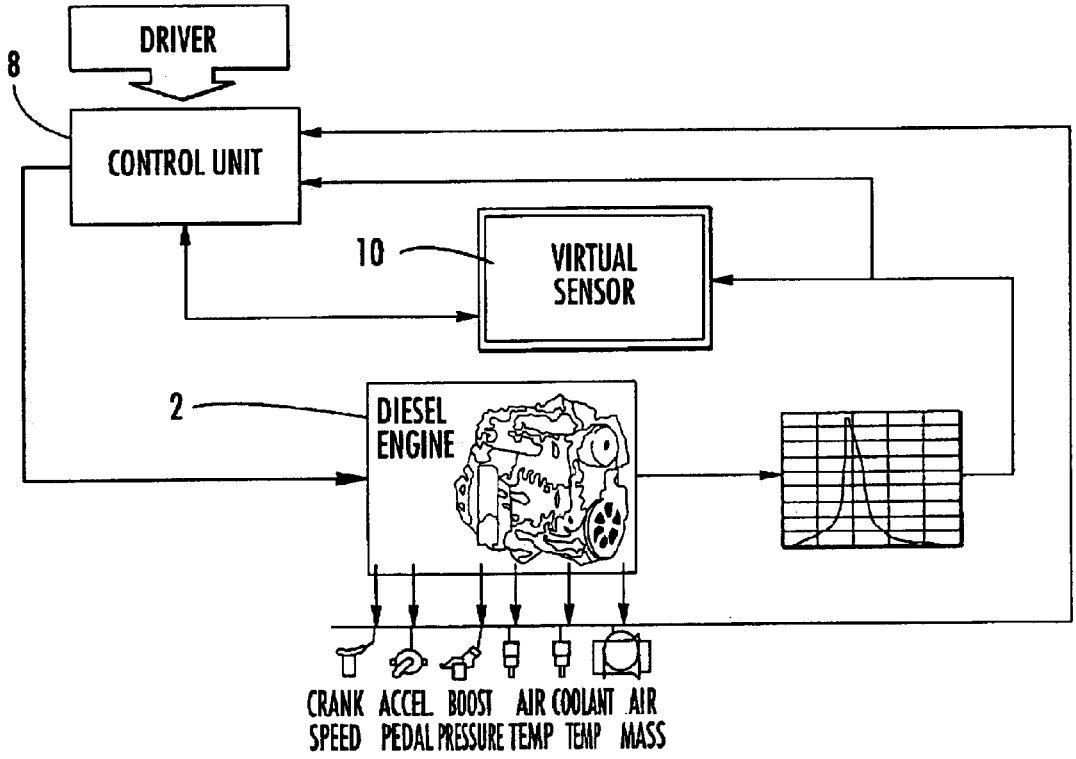
FIG. 6 is a general diagram of an engine control system according to the invention.

Calculation block 5 is the heart of the virtual sensor 10, and is preferably constructed by implementing a soft computing model of the phenomena connected with the emissions. More particularly, this block 5 may be a neuro-fuzzy processor, e.g. of the WARP III type, manufactured by the Assignee, STMicroelectronics, and yielding highly accurate predictions. Advantageously, sensor 10 is placed as an ancillary element between the electronic injection control unit 8 and the engine 9, as shown in FIG. 6.

As mentioned above, sensor 10 works on a virtual evaluation principle based on measuring certain classic engine variables and the combustion chamber pressure, because of the difficulty of making direct measurements of quantities related to exhaust emissions, and to provide a real-time evaluation of the emissions in an efficient manner. The measured quantities are then processed by using a soft computing model and neuro-fuzzy logics. Equipping an internal combustion endothermic engine with this sensor 10 allows the performances of the control system and the OBD to be improved on account of the information about the amounts of pollutants issuing from the engine being made available in real time.

Inspection of the combustion chamber pressure curves shown in FIGS. 4A, 4B and 4C reveals that the crank angle at injection time bears a close relation to the curve characteristics and the relevant amounts of exhaust pollutants. Substantial advance in SOI (Start Of Injection) timing produces large temperature and pressure gradients accompanied by release of nitrogen oxide and noisy operation. Conversely, when SOI is retarded, incomplete combustion occurs with heavy emissions of unburned hydrocarbons, loss of efficiency, and increased fuel usage. Thus, from the characteristics of the chamber pressure curve, an evaluation of the proportions of different exhaust pollutants can be inferred. Briefly, a rough combustion results in increased percent $NO_x$, while retarded ignition releases a larger proportion of unburned hydrocarbons HC in the exhaust gases.

This antithetic pattern of $NO_x$ versus HC as the injection timing is altered, and accordingly the relevant pressure curve changed, is handled for the best by the soft computing block being capable of modelling highly complex non-linear phenomena. As discussed above, the combustion chamber pressure measurements are provided by an AVL precision sensor. The chamber pressure signal, being a function of crank angle, has been measured by changing the RPM from 1000 to 2600, and at each RPM value as torque varies, for a total of 100 engine cycles.

Figure 7:
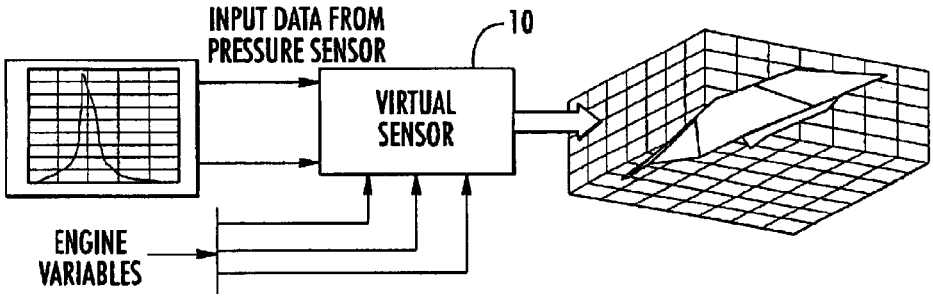
FIG. 7 schematically shows input signals to the virtual sensor of the invention and the form of the engine model.

From such measurements, certain signal characterizing quantities were calculated: the highest value of the chamber pressure; the mean pressure value over 100 cycles; the combustion start mean value, as calculated over 100 cycles; and the injection start mean value over 100 cycles. A neuro-fuzzy model of the engine system having four inputs and two outputs was constructed from the experimental measurement data as schematically shown in FIG. 7.

Figure 8:
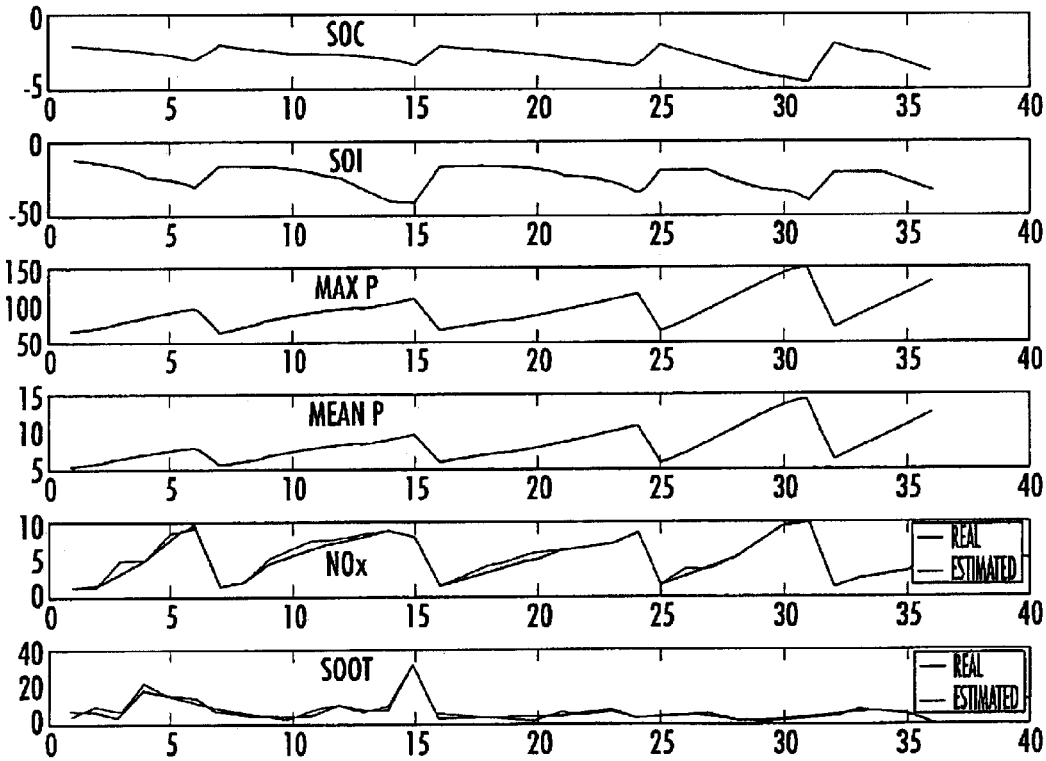
FIG. 8 shows curves representing true input-output signals and estimated output signals of the sensor, plotted against the same time base.

The inputs are: Maximum pressure; Mean pressure; Start of combustion; and Start of injection. The outputs are estimates of nitrogen compounds and particulates: $NO_x$ and Soot Plotted in FIG. 8 against a common time base are the patterns of the signals that are relevant to the model inputs (start of combustion, start of injection, maximum pressure, mean pressure) and the calculated outputs ($NO_x$ and particulate). The curves estimated by the sensor 10 have been superposed on those actually measured; a surprisingly close match is observed. It can be seen that the model outputs track the true ones. Indeed, even better results could be obtained by increasing the model complexity.

Briefly, the invention provides a system for evaluating the exhaust emissions from internal combustion engines, which is based on measuring the pressure inside the combustion chamber. In view of the simple model and relatively low processing cost, the virtual sensor of this invention provides an effective tool for improving the performance of the injection control unit and the OBD. The system allows the emissions generated at each engine cycle to be evaluated and optionally controlled to conform with international directives.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A virtual sensor for exhaust emissions from a fuel-injected engine having a combustion chamber in each cylinder, at least one fuel injector serving the combustion chambers, at least one pressure sensor mounted in at least one combustion chamber of the engine, and an electronic fuel-injection control unit, the virtual sensor comprising:

a first input interface receiving a pressure signal from the at least one pressure sensor mounted in the at least one combustion chamber of the engine;

a second input interface receiving fuel-injection signals from the electronic fuel-injection control unit; and a calculation block generating estimates of amounts of emissions based on the pressure signal and the fuel-injection signals.

2. The virtual sensor according to claim 1, wherein the fuel-injection signals are measurements of engine operation parameters comprising at least one of crank angle and injection start time.

3. The virtual sensor according to claim 1, further comprising a signal extraction block connected between the first input interface and the calculation block to extract the pressure signal.

4. The virtual sensor according to claim 1, further comprising a signal processing block connected between the second interface and the calculation block.

5. The virtual sensor according to claim 1, wherein the calculation block operates according to a soft computing model.

6. The virtual sensor according to claim 1, wherein the calculation block comprises a neuro-fuzzy processor.

7. The virtual sensor according to claim 1, wherein the calculation block comprises at least four inputs and two outputs, the inputs receiving signals corresponding to a maximum pressure and a mean pressure as measured by the sensor, combustion start time and injection start time.

8. The virtual sensor according to claim 7, wherein the outputs are electric signals corresponding to an estimate of nitrogen compounds and particulates in the emissions from the engine.

9. A fuel injection control system for a fuel injection endothermic engine having a combustion chamber in each cylinder, at least one fuel injector serving the combustion chambers, and an electronic fuel-injection control unit, the system comprising:

at least one pressure sensor in at least one combustion chamber; and a virtual sensor comprising a first input interface receiving a pressure signal from the at least one pressure sensor, a second input interface receiving fuel-injection signals from the electronic fuel-injection control unit, and a calculation block generating estimates of amounts of emissions based on the pressure signal and the fuel-injection signals.

10. The system according to claim 9, wherein the fuel-injection signals are measurements of engine operation parameters comprising at least one of crank angle and injection start time.

11. The system according to claim 9, wherein the virtual sensor further comprises a signal extraction block connected between the first input interface and the calculation block to extract the pressure signal.

12. The system according to wherein claim 9, wherein the virtual sensor further comprises a signal processing block connected between the second interface and the calculation block.

13. The system according to wherein claim 9, wherein the calculation block operates according to a soft computing model.

14. The system according to claim 9, wherein the calculation block comprises a neuro-fuzzy processor.

15. The system according to claim 9, wherein the calculation block comprises at least four inputs and two outputs, the inputs receiving signals corresponding to a maximum pressure and a mean pressure as measured by the sensor, combustion start time and injection start time.

16. The system according to wherein claim 15, wherein the outputs are electric signals corresponding to an estimate of nitrogen compounds and particulates in the emissions from the engine.

17. The system according to claim 9, wherein the engine comprises a common-rail diesel engine.

18. A method of determining exhaust emissions from a fuel-injected endothermic engine having a combustion chamber in each cylinder, at least one fuel injector serving the combustion chambers, at least one pressure sensor mounted in at least one combustion chamber of the engine, and an electronic fuel-injection control unit, the method comprising:

obtaining a pressure signal from the at least one pressure sensor mounted in the at least one combustion chamber of the engine;

obtaining fuel-injection signals from the electronic fuel-injection control unit; and generating estimates of amounts of emissions based on the pressure signal and the fuel-injection signals.

19. The method according to wherein claim 18, wherein the fuel-injection signals are measurements of engine operation parameters comprising at least one of crank angle and injection start time.

20. The method according claim 18, wherein providing estimates comprises operating a calculation block according to a soft computing model.

21. The method according to claim 20, wherein the calculation block comprises a neuro-fuzzy processor.

22. The method according to claim 21, wherein the calculation block comprises at least four inputs and two outputs, the inputs receiving signals corresponding to a maximum pressure and a mean pressure as measured by the sensor, combustion start time and injection start time.

23. The method according to claim 22, wherein the outputs are electric signals corresponding to an estimate of nitrogen compounds and particulates in the emissions from the engine.

* * * * *

UNITED STATES PATENT AND TRADEMARK OFFICE

CERTIFICATE OF CORRECTION

PATENT NO. : 6,925,373 B2
DATED : August 2, 2005
INVENTOR(S) : La Rosa et al.

It is certified that error appears in the above-identified patent and that said Letters Patent is hereby corrected as shown below:

Column 8,
Lines 50, 54 and 64, delete “to wherein claim” insert -- to claim --.

Column 9,
Line 17, delete “to wherein claim” insert -- to claim --.

Column 10,
Line 3, delete “according claim” insert -- according to claim --.

Signed and Sealed this

Thirteenth Day of December, 2005

JON W. DUDAS
*Director of the United States Patent and Trademark Office*